US006142348A

United States Patent [19]

Park

[11] Patent Number: 6,142,348

[45] Date of Patent: Nov. 7, 2000

[54] BUCKLE WITH DETACHABLE BALL MARKER

[76] Inventor: Hee-Chang Park, 1-1204, Anam Apartment, 67, Ogum-dong, Songpa-ku, Seoul, Rep. of Korea

[21] Appl. No.: 09/134,352

[22] Filed: Aug. 14, 1998

[30] Foreign Application Priority Data

Jun. 24, 1998 [KR] Rep. of Korea ..... 98-11012

[51] Int. Cl.[7] ..... A44B 11/00

[52] U.S. Cl. ..... 224/163; 224/163; 224/183; 224/918

[58] Field of Search ..... 224/163, 183, 224/918; 24/163 K, 303, 588, 182, 183; 473/285, 406; 335/285

[56] References Cited

U.S. PATENT DOCUMENTS

| | | | |
|---|---|---|---|
| 1,495,925 | 5/1924 | Quertermous | 24/182 |
| 2,979,335 | 4/1961 | Pruitt | 473/285 |
| 3,136,547 | 6/1964 | Schaper | 224/918 |
| 3,208,123 | 9/1965 | Koos | 24/163 K |
| 5,310,101 | 5/1994 | Park et al. | 224/163 |
| 5,795,248 | 8/1998 | Giglio | 244/918 |

*Primary Examiner*—Gregory M. Vidovich
*Assistant Examiner*—Maerena W. Brevard
*Attorney, Agent, or Firm*—Birch, Stewart, Kolasch & Birch, LLP

[57] ABSTRACT

A buckle, provided with a detachable golf ball marker for allowing a wearer to easily carry such a marker while playing golf, is disclosed. In the buckle, the decoration part has a marker seat at its external surface and carries a first magnet on the seat. The golf ball marker has a second magnet with the magnetic polarity of the second magnet being opposite to that of the first magnet. The marker is thus magnetically and detachably seated on the marker seat. In another embodiment, a metal piece is externally mounted to a loop of the buckle, while the ball marker is magnetically attached on the metal piece. The buckle thus allows a golfer to easily carry the marker without forgetting it and also allows the golfer to devote himself to playing golf.

1 Claim, 3 Drawing Sheets

BUCKLE WITH DETACHABLE BALL MARKER

BACKGROUND OF THE INVENTION

1. Field of the Invention

The present invention relates, in general, to a buckle for belts and, more particularly, to a buckle provided with a detachable ball marker, thus allowing a wearer to easily mark the position of his ball on a putting green using the marker while he waits for another player to shoot toward the green prior to replacing his ball on the green to putt.

2. Description of the Prior Art

A belt is typically worn around the waist to support trousers, pants or slacks. The two ends of such a belt are fastened together by a buckle. Such buckles also serve a decorative function. The construction and operational function of such buckles has been improved to allow wearers to more easily and quickly fasten or unfasten the two ends of a belt.

Therefore, a great number of buckles, designed for allowing wearers to quickly and easily fasten or unfasten the two ends of belts, have been proposed and used.

As the buckles for belts are diversified in their kinds, they have been designed for having collateral functions and decorations.

In another matter, ball markers are typically used for marking the position of a golf ball on a putting green while a golfer waits for another player to shoot toward the green prior to replacing his ball on the green to putt. That is, when a golfer shoots his ball onto a putting green and successfully places the ball on the green, he has to temporarily take off the ball from the green to prevent the ball from disturbing another player's shot onto the green. In such a case, the golfer marks the position of his ball on the green using a ball marker while he waits for another golfer's shot toward the green prior to replacing the ball on the green to putt. Such a marker allows a golfer to exactly replace a ball on the putting green. The use of such markers are prescribed in the golf rules.

In the prior art, small-sized and coin-shaped articles, made of plastic materials, are used as such ball markers. However, golfers may play golf without having such markers and this throws the golfers into confusion on putting greens and prevents the golfers from devoting themselves to playing golf. Furthermore, the golf rules say that a golfer, who does not use such a marker on a putting green, is to receive a one point penalty.

SUMMARY OF THE INVENTION

Accordingly, the present invention has been made keeping in mind the above problems occurring in the prior art, and an object of the present invention is to provide a buckle, which is provided with a detachable ball marker, thus allowing a wearer to easily carry such a marker, used for marking the position of his ball on a putting green while he waits for another player's shot for the green prior to replacing his ball on the green to putt, without forgetting it.

In order to accomplish the above object, a buckle according to the primary embodiment of this invention comprises a decoration part and a golf ball marker. The decoration part has a belt clamp used for clamping the buckle to a belt, a hooking post formed on a position opposite the clamp and used for selectively fastening two ends of the belt together, and a marker seat provided on the external surface of the decoration part and carrying a first magnet. The golf ball marker is provided with a second magnet having a magnetic polarity opposite to that of the first magnet, so that the marker is magnetically and detachably seated on the marker seat of the decoration part.

In another embodiment, the buckle comprises a belt clamp used for clamping the buckle to a belt, a hooking post used for selectively fastening two ends of the belt together, a loop provided at a position around the belt clamp and used for allowing a free end of the belt to pass through, thus holding and neatening the end of the belt without releasing it, a metal piece externally mounted to the loop, and a golf ball marker magnetically and detachably attached on the metal piece.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
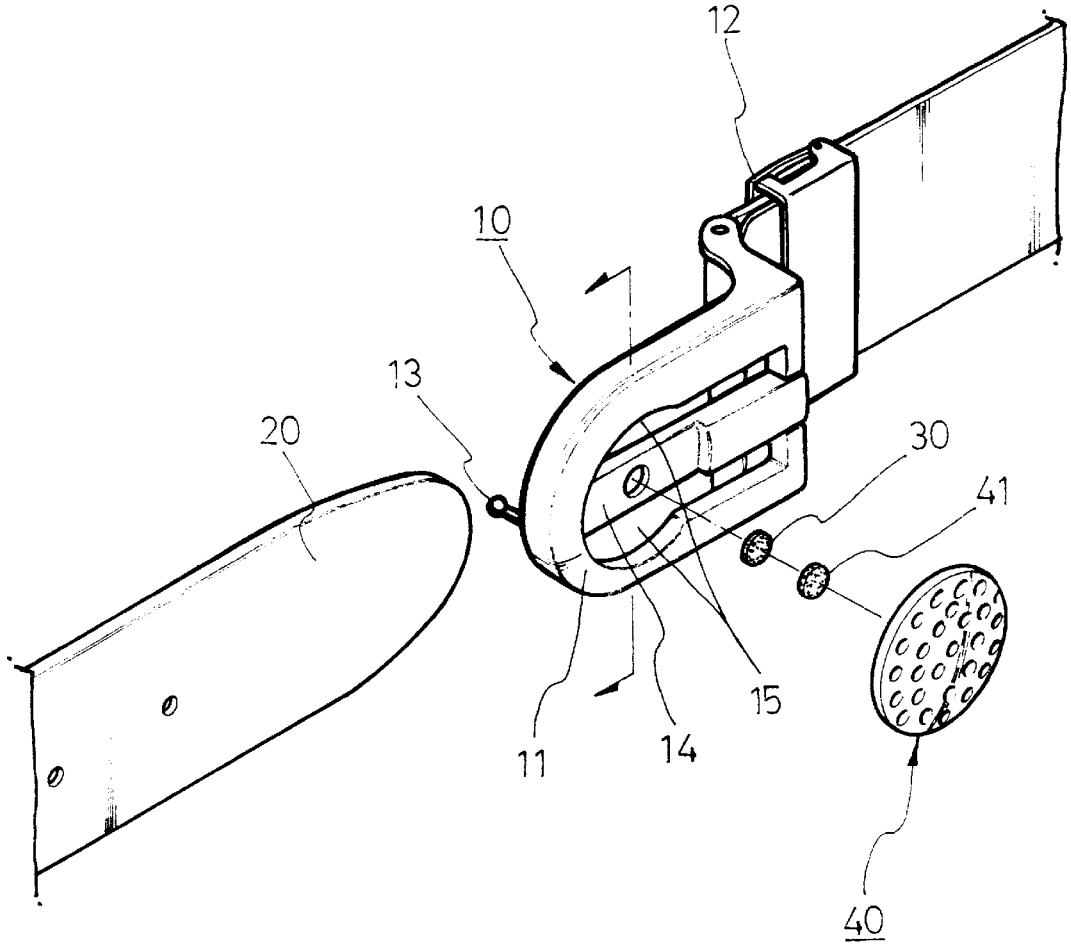
FIG. 1 is an exploded perspective view of a buckle provided with a detachable ball marker in accordance with the primary embodiment of the present invention.
Figure 2A:
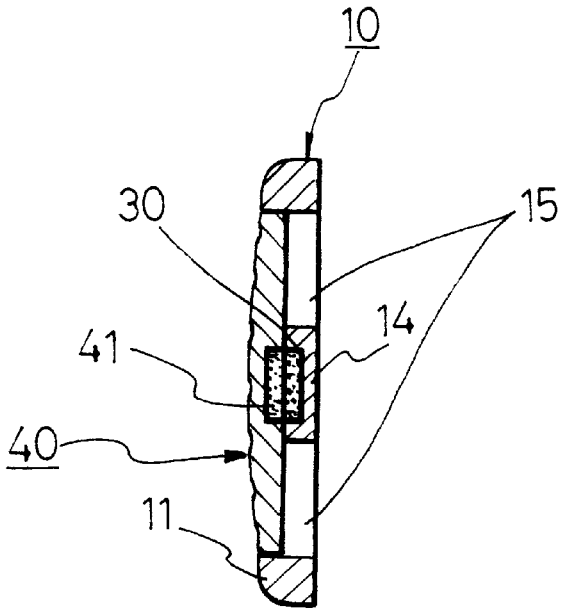
FIGS. 2*a* and 2*b* are sectional views of the buckle of FIG. 1, respectively showing the marker attached on or detached from the buckle.
Figure 2B:
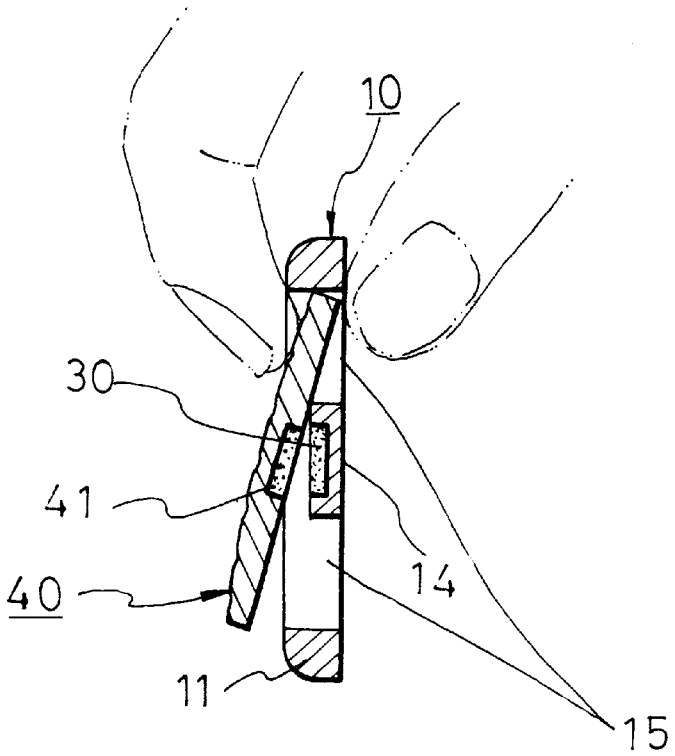

FIG. 1 is an exploded perspective view of a buckle provided with a detachable ball marker in accordance with the primary embodiment of the present invention. FIGS. 2*a* and 2*b* are sectional views of the buckle of FIG. 1, respectively showing the marker attached on or detached from the buckle. In the primary embodiment, the invention is adapted to a buckle 10 having a decoration part 11. That is, the buckle 10 according to the primary embodiment comprises a decoration part 11 with a belt clamp 12 being provided at one end of the decoration part 11. The above clamp 12 is used for clamping the buckle 10 to one end of a belt 20. A hooking post 13 is formed on the other end of the decoration part 11. The hooking post 13 is selectively inserted into one of a plurality of regularly-spaced holes of the other end of the belt 20, thus fastening the two ends of the belt 20 together.

At least one magnet or a first magnet 30 is fixedly set on the external surface of the above decoration part 11. A coin-shaped ball marker 40, provided with a second magnet 41 having a magnetic polarity opposite to that of the first magnet 30, is magnetically attached to the first magnet 40 of the decoration part 11.

In the present invention, it is preferable to depress the external surface of the decoration part 11 to a depth, thus forming a circular marker seat on the part 11. In the primary embodiment, an opening 15 is formed on the decoration part 11, while a rib 14 horizontally extends across the opening 15. The above rib 14 is partially stepped at its external surface to form such a marker seat in cooperation with the opening 15 and carries the first magnet 30 on its stepped surface. Due to such a magnet seat, the external surface of the marker 40 is completely leveled with the external surface of the decoration part 11 when the marker 40 is magnetically seated in the marker seat.

If either or both the decoration part 11 and the marker 40 is made of a magnetically attractable material, such as steel, it is possible for the buckle 10 to be provided with one magnet 30, 41.

In the primary embodiment, since the marker 40 is magnetically attached to the decoration part 11 of the buckle 10 using the two magnets 30 and 40 having opposite polarities, the marker 40 is almost completely prevented from being unexpectedly separated from the buckle 10. When it is necessary to use the marker 40 on a putting green, the marker 40 is eccentrically pressed at its upper or lower part by, for example, a finger with the rib 14 acting as a point of application during a levering motion. In such a case, the marker 40 is easily detached from the magnet 30 while overcoming the magnetic attraction between the two magnets 30 and 40.

Even when the ball marker 40 is removed from the buckle 10, the buckle 10, of course, continues to perform its original function of fastening the two ends of the belt 20 together.

Figure 3:
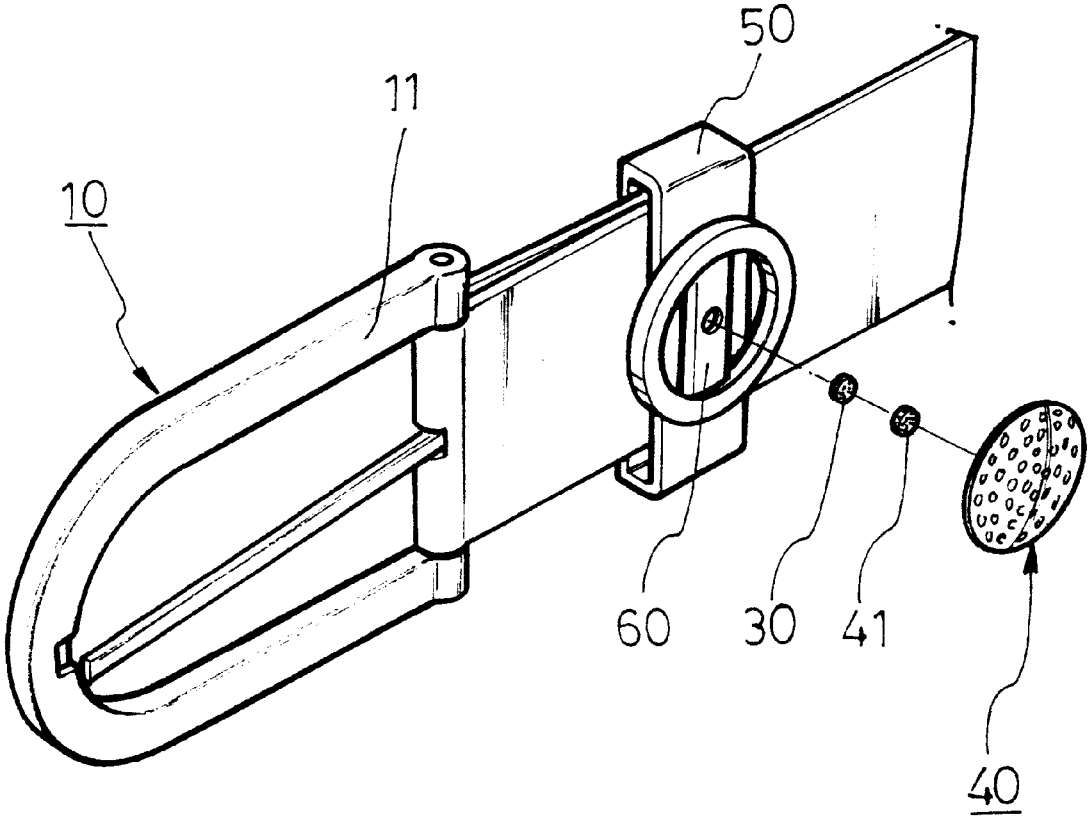
FIG. 3 is an exploded perspective view of a buckle provided with a detachable ball marker in accordance with the second embodiment of the present invention.

FIG. 3 is an exploded perspective view of a buckle provided with a detachable ball marker in accordance with the second embodiment of this invention. In the second embodiment, the present invention is adapted to a buckle free from any decoration part different from the buckle of the primary embodiment. Since the buckle 10 of this embodiment is free from such a decoration part 11, the first magnet 30 is carried on a metal piece 60 mounted to the external surface of a loop 50 in place of the decoration part 11. Such a loop 50 is typically provided on the buckle 10 at a position around the belt clamp and allows the other end of the belt 20 to pass through, thus holding and neatening the end of the belt 20 without releasing it. In the embodiment of FIG. 2, the buckle 10 is integrated with the belt and the loop 50 is fitted over the belt at a position around the buckle 10. The above metal piece 60, mounted to the loop 50, preferably has a marker seat, with a rib passing across the seat and carrying the first magnet 30. The external surface of the marker 40 is thus leveled with the external surface of the edge of the metal piece 60. The above marker 40 also has a second magnet 41 in the same manner as that described for the primary embodiment.

Since the loop 50 is typically made of a narrow strip, the loop 50 cannot provide a large area for the metal piece 60. In this regard, both the marker 40 and the metal piece 50 of the second embodiment may be small-sized.

When the buckle of this invention has both the decoration part 11 and the loop 50, the buckle may have two markers 40 respectively provided at the decoration part 11 and the loop 50.

The buckle 10 of this invention thus allows a wearer to easily carry at least one ball marker 40, used for marking the position of his ball on a putting green while he waits for another player's shot for the green prior to replacing his ball on the green to putt, without forgetting it.

As described above, the present invention provides a buckle provided with a detachable ball marker. The above marker, used for marking the position of a golf ball on a putting green while a golfer waits for another player's shot for the green prior to replacing his ball on the green to putt, is magnetically and detachably attached to either or both the decoration part and the loop of the buckle. The buckle thus allows a golfer to easily carry the marker without forgetting it or losing it. Even when the ball marker is removed from the buckle, the buckle, of course, continues to perform its original function of fastening the two ends of a belt together.

The buckles of this invention also allow golfers to be free from separately carrying ball markers, thus allowing the golfers to devote themselves to playing golf.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A buckle, comprising:

a decoration part having:

a belt clamp used for clamping the buckle to a belt;

a hooking post formed on a position opposite to said clamp and used for selectively fastening two ends of the belt together;

a first through-opening formed on said decoration part;

a marker seat formed by a rib horizontally extending across said first through-opening while leaving upper and lower through-openings inside the first through-opening of the seat relative to the rib, said rib also carrying a first magnet and acting as a point of application during a levering motion for detaching the marker from the seat; and a golf ball marker provided with a second magnet having a magnetic polarity opposite to that of said first magnet, said marker being magnetically and detachably seatable on said marker seat of the decoration part.

* * * * *